US005937476A

United States Patent [19]

Kim

[11] Patent Number: 5,937,476

[45] Date of Patent: Aug. 17, 1999

[54] VACUUM CLEANER HAVING AN APPARATUS FOR RELEASING CORD REEL OF CORD WINDER

[75] Inventor: Suk-Koo Kim, Seoul, Rep. of Korea

[73] Assignee: Daewoo Electronics Co., Ltd., Seoul, Rep. of Korea

[21] Appl. No.: 08/994,650

[22] Filed: Dec. 19, 1997

[30] Foreign Application Priority Data

Mar. 31, 1997 [KR] Rep. of Korea ..... 97-6390

[51] Int. Cl.[6] ..... A47L 9/26

[52] U.S. Cl. ..... 15/323; 242/381.3; 242/385.4; 191/12.2 R

[58] Field of Search ..... 15/323; 242/381.1, 242/381.2, 381.3, 385.4; 191/12 R, 12.2 R, 12.4, 12.2 A

[56] References Cited

FOREIGN PATENT DOCUMENTS 0 714 626 6/1996 European Pat. Off. .

1 220 789 1/1971 United Kingdom .

*Primary Examiner*—Robert Warden
*Assistant Examiner*—Jennifer McNeil
*Attorney, Agent, or Firm*—Pillsbury Madison & Sutro LLP

[57] ABSTRACT

A vacuum cleaner with a cord-reel release apparatus provides a handle in place of a cord reel button. The cord-reel release apparatus has a cord reel, a brake member, an elastic member, and a handle. The cord reel winds a power cord. The brake member is in contact with circumference of the cord reel and selectively limits rotation of the cord reel. The elastic member causes one part of the brake member to contact with the cord reel. The handle presses the other part of the brake member. The handle further has a hooking prominence formed on a side part thereof, thereby the hooking prominence is hooked to a hooking depression formed in an accommodation groove of a body. With the constitution, when the brake member is pressed by the handle, the brake member departs from the cord reel. Then, the power cord drawn out is wound up at the cord reel by elastic force of a spiral spring in the cord reel. By the cord-reel release apparatus, a simple constitution, low cost, and high productivity are accomplished.

5 Claims, 6 Drawing Sheets

VACUUM CLEANER HAVING AN APPARATUS FOR RELEASING CORD REEL OF CORD WINDER

BACKGROUND OF THE INVENTION

1. Field of the Invention

This invention relates to a vacuum cleaner, more particularly to a vacuum cleaner having an apparatus for releasing a cord reel which has a handle used for a cord reel button and controls the rotation of the cord reel.

2. Prior Art

A conventional vacuum cleaner filters dust and the like through a filtering film and outputs purified air.

For convenience while moving from one spot to another spot, the conventional vacuum cleaner has a handle which is installed to rotate at a rotational axis.

FIG. 1 is a perspective view showing a conventional vacuum cleaner. The conventional vacuum cleaner has a wheel 100, a body 101, a handle 103, a power cord 105, and a cord reel button 107.

As shown in FIG. 1, the body 101 moves by the revolution of the wheel 100. The handle 103, which may be rotated at the rotational axis, is installed on the body 101. The handle 103 is parallel to the upper surface of the body 101 when the conventional vacuum cleaner is not in use. And the handle 103 is perpendicular to the upper surface of the body 101 when the conventional vacuum cleaner is in use. In other words, the handle 103 is coupled with the body 101 so that the handle 103 may rotate at the rotational axis between parallel position and perpendicular position to the surface of the body 101.

FIG. 2 is a partly sectional view schematically showing the constitution of the conventional apparatus for releasing a cord reel. The conventional cord-reel release apparatus has the cord reel button 107, a spring 211, a friction member 213, a spiral spring 215, a cord reel 217, and a cord reel lever 219. In addition, the body 101, the handle 103, and the power cord 105 are shown in FIG. 2.

As shown in FIG. 2, the cord reel 217 has the spiral spring 215 therein and has potential energy to rotate in one direction of taking the power cord 105 thereinto.

One part of the friction member 213 is in contact with the cord reel 217 and limits the rotation of cord reel 217. And the other part of the friction member 213 is coupled with the cord reel lever 219.

The other part of the cord reel lever 219 is coupled with the cord reel button 107. Therefore the cord reel lever 219 operates according to the cord reel button 107. At this time, the cord reel lever 219 rotates at a rotation center. One part of the spring 211 is supported by a predetermined position in the body 101, and the other part thereof is coupled with the cord reel lever 219 at the rotation center. The spring 211 causes the friction member 213 to be in contact with the cord reel 217.

With the above-mentioned constitution, the conventional cord-reel release apparatus allows the power cord 105 to be drawn out when the drawing out begins, but blocks reverse rotation of the cord reel 217 due to the spring 211 when the drawing out stops.

That is, the cord reel button is pushed down, then the cord reel lever 219 overcomes the elastic force of the spring 211. Thus the cord reel lever 219 rotates at the rotation center. As a result, the power cord 105 is retracted into the body 101 and wound on the cord reel 217.

The conventional vacuum cleaner with the above-mentioned constitution and operation has a handle and a cord reel button. Actually, it is the cord reel lever that controls the rotation of the cord reel. In other words, the cord reel button is a surplus element. As a result, the conventional cord-reel release apparatus has disadvantages in cost, productivity, and the like.

THE SUMMARY OF THE INVENTION

This invention has been proposed to overcome the above described problems in the prior art, and accordingly it is an object of this invention to make the constitution of the vacuum cleaner simple. Another object of this invention is to reduce the cost for manufacturing. Still another object of this invention is to enhance productivity.

To achieve the objects, this invention provides a handle for use in a cord reel button as a substitute for the cord reel button. That is, the apparatus for releasing a cord reel includes:

a cord reel which winds a power cord and holds an elastic force in a direction that the power cord is wound; a brake member where one part thereof is in contact with circumference of the cord reel to selectively limit rotation of the cord reel, and rotates at a predetermined rotation center; an elastic member which makes the one part of the brake member in contact with the circumference of the cord reel; and a handle which presses the other part of the brake member and releases the cord reel from the blocked rotation when the handle is closed.

The handle is installed on an upper surface of a body, and is installed to axially rotate at a rotational axis located on one end part thereof. In addition, the handle further includes a hooking prominence formed on a side part thereof, thereby the hooking prominence is hooked to a hooking depression which is formed in an accommodation groove of the body to correspond with the hooking prominence.

With the above-mentioned constitution, this invention allows a user to selectively press the cord reel lever by means of the handle, which is coupled with the body with the handle being axially rotated against the body. That is, the handle may control the rotation of the cord reel.

Therefore, this invention does not need an additional cord reel button to cover the cord reel lever. Such unessential cord reel button makes the constitution of the vacuum cleaner simple. The reduction in the number of the components reduces the cost for manufacturing. As a result, productivity is enhanced.

BRIEF DESCRIPTION OF THE DRAWINGS

This invention will be better understood and its objects and advantages will be more fully appreciated from the following description taken in conjunction with the accompanying drawing, in which.

DETAILED DESCRIPTION OF THE PREFERRED EMBODIMENTS

Hereinafter, the vacuum cleaner having an apparatus for releasing a cord reel of a cord winder according to this invention will be described in detail with reference to the accompanying drawings.

Figure 1:
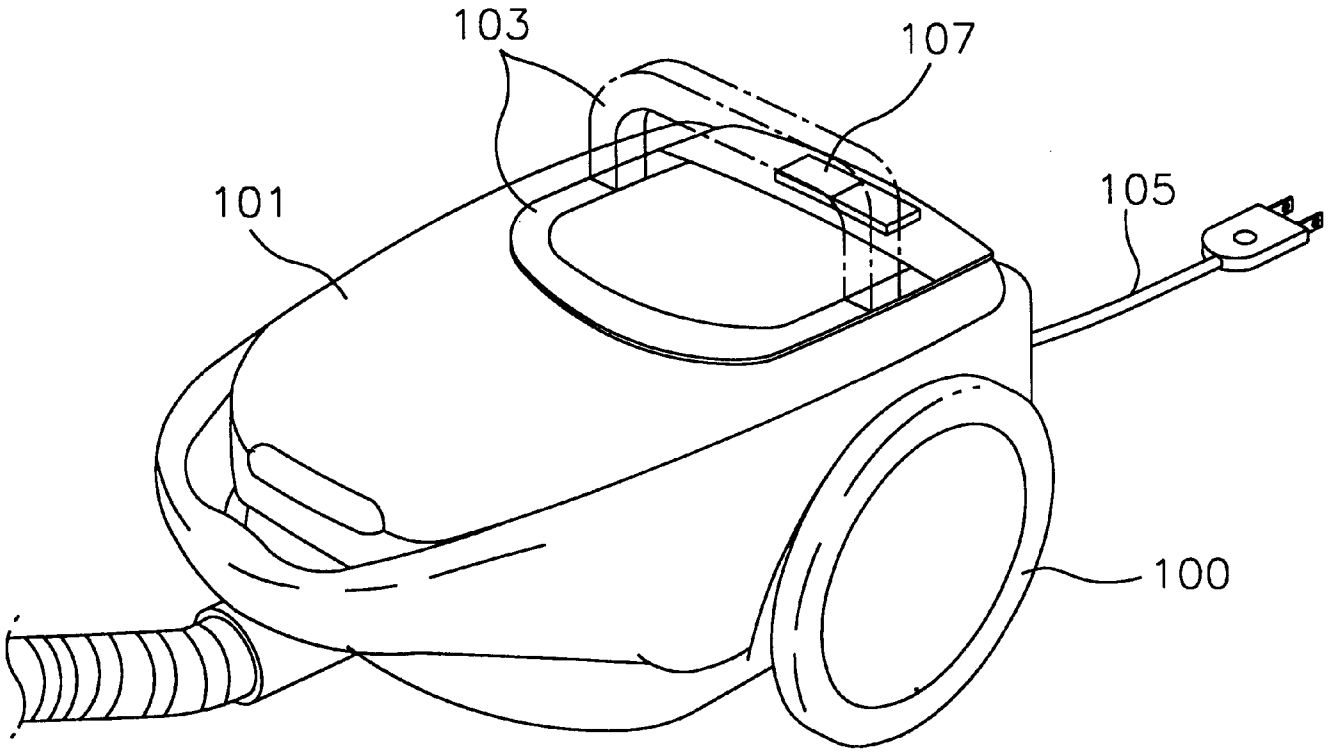
FIG. 1 PRIOR ART
FIG. 1 is a perspective view schematically showing a conventional vacuum cleaner.
Figure 2:
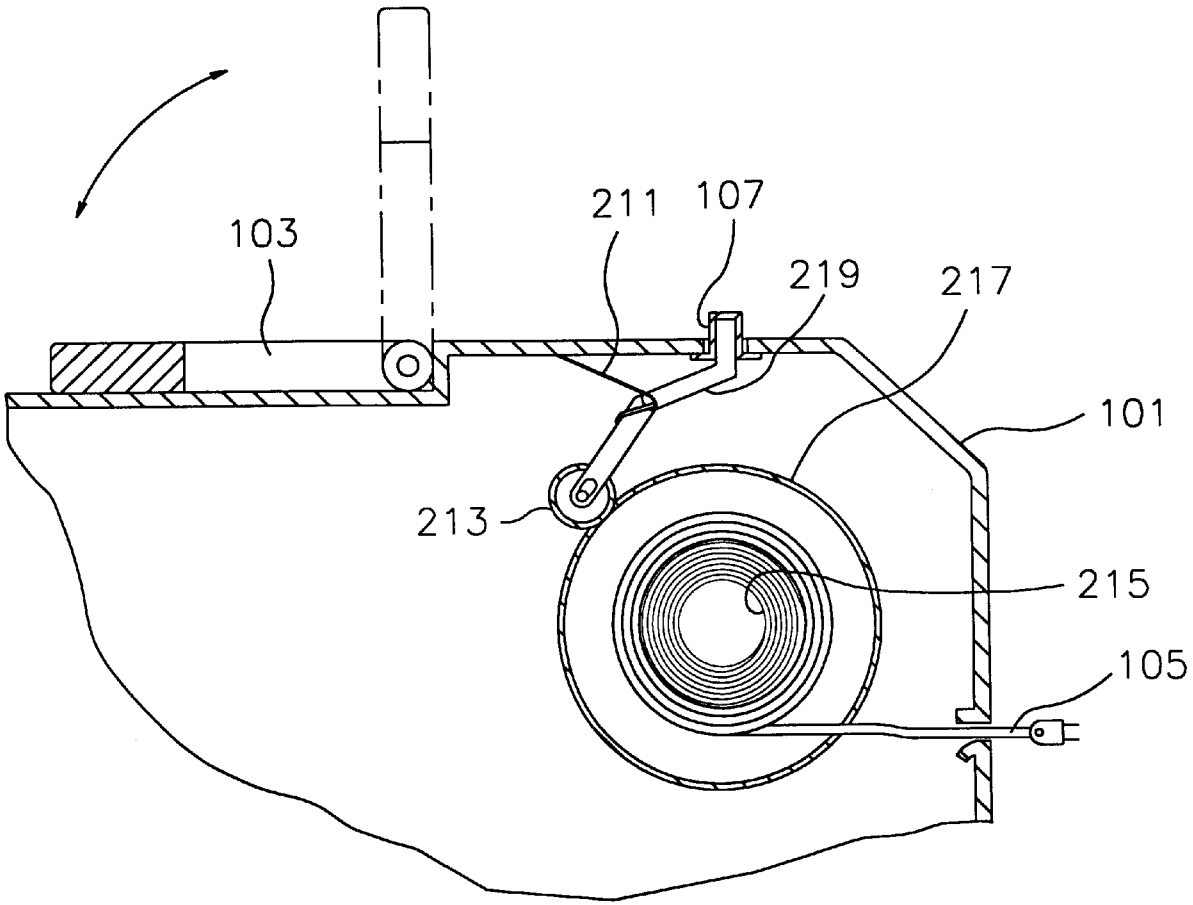
FIG.2 PRIOR ART
FIG. 2 is a partly sectional view schematically showing a cord-reel release apparatus of the conventional vacuum cleaner shown in FIG. 1.
Figure 3:
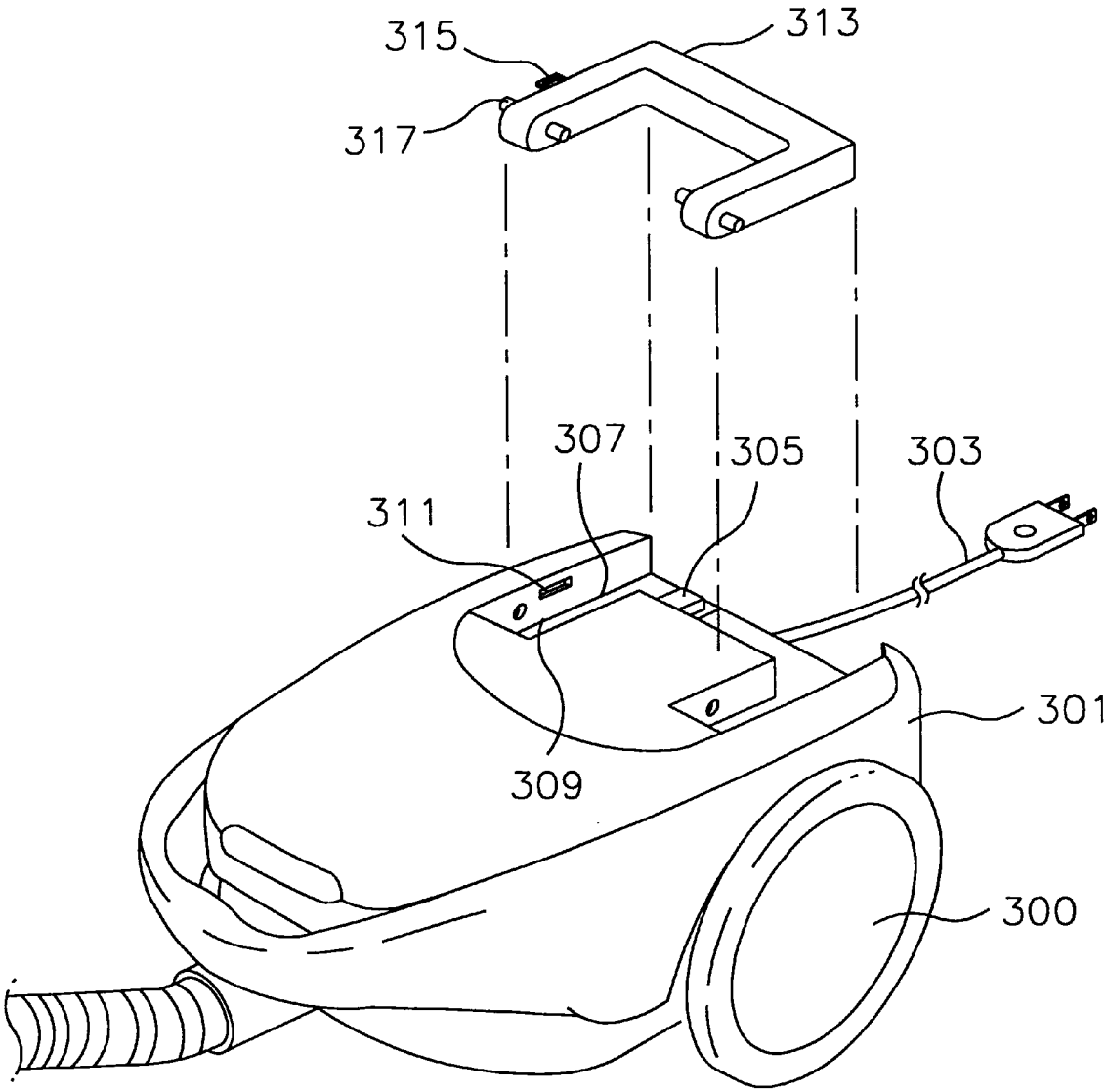
FIG. 3 is a perspective view schematically showing a vacuum cleaner with a handle separated from a body according to this invention.

FIG. 3 is a perspective view schematically showing a vacuum cleaner with a handle separated from a body according to this invention. This invention has a wheel 300, a body 301, a power cord 303, a cord reel lever 305, an accommodation groove 307, a rotation depression 309, a hooking depression 311, a handle 313, a hooking prominence 315, and a rotation prominence 317.

The body 301 moves by the revolution of the wheel 300.

The accommodation groove 307 is formed in the upper surface of the body 301 with the shape of recess so that the handle 313 may be rotated at a rotational axis of an end part thereof. Also, the accommodation groove 307 is formed to accommodate the handle 313 with the upper surface of the handle 313 being parallel to the upper surface of the body 301 when the handle 313 is accommodated in the accommodation groove 307.

The rotation depressions 309 are formed at the lower side part of the accommodation groove 307 to furnish the handle with the rotational axis. The hooking depression 311 is formed at a side wall of the accommodation groove 307 to distinguish between the use position and the non-use position of the handle 313. The cord reel lever 305 protrudes on the rear surface of the body 301 in the accommodation groove 307.

The rotation prominences 317 corresponding to the rotation depressions 309 are formed at an end part of the handle 313 so that the handle 313 may be rotated at the rotational axis in the accommodation groove 307. The hooking prominence 315 corresponding to the hooking depression 311 is formed at a side part of the handle 313 to distinguish between the use position and the non-use position of the handle 313.

Figure 4:
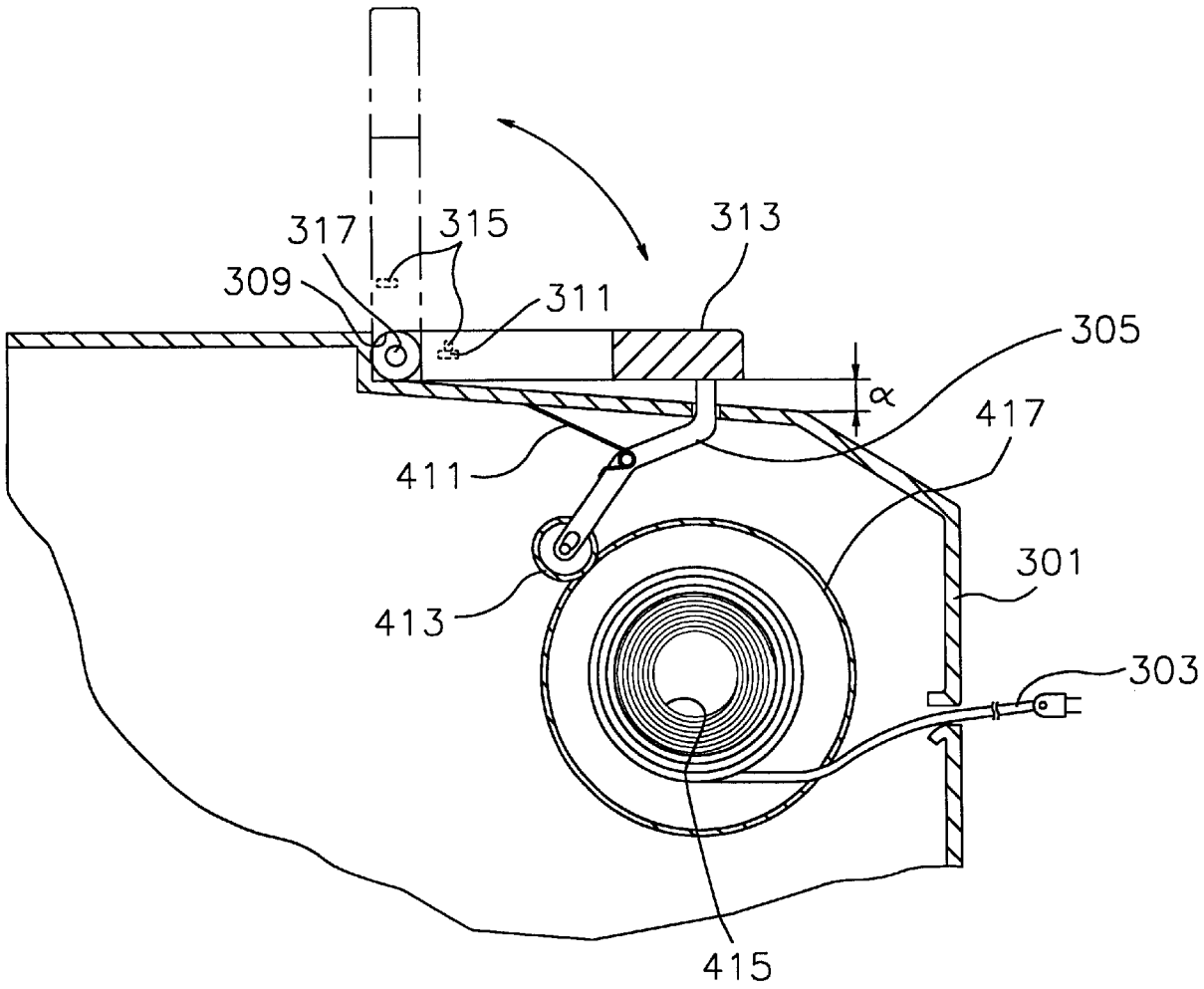
FIG. 4 is a sectional view showing a cord-reel release apparatus of the vacuum cleaner shown in FIG. 3.

FIG. 4 is a sectional view showing a cord-reel release apparatus of the vacuum cleaner shown in FIG. 3. In FIG. 4, the body 301, the power cord 303, the cord reel lever 305, the rotation depression 309, the hooking depression 311, the handle 313, the hooking prominence 315, the rotation prominence 317, a spring 411, a friction member 413, and a spiral spring 415 are illustrated.

The handle 313 is rotated between the parallel position and the perpendicular position to the upper surface of the body 301. It is desirable for the bottom surface of the accommodation groove to have a slope of a predetermined angle ($\alpha$) against the upper surface of the body 301 upon considering the protruded cord reel lever 305 on the bottom surface of the accommodation groove. With the slope, when the hooking prominence 315 is hooked in the hooking depression 311 during the non-use position, the handle 313 is axially rotated clockwise as much as the slope angle ($\alpha$) so that the handle 313 is in close contact with the bottom of the accommodation groove. That is, the handle 313 is sloped as much as the slope angle ($\alpha$).

The cord reel lever 305, where one part thereof is pressed by the handle 313, is installed so that the handle 313 may rotate at the rotational axis thereof. The friction member 413 is coupled with the other part of the cord reel lever 305. The spring 411 with a predetermined elastic force, in which one part thereof is supported by a predetermined position and the other part thereof is coupled with a rotation shaft, causes the friction member 413 to come in contact with the cord reel 417.

The circumference of the cord reel 417 may be formed with a shape of a saw-toothed wheel, that is a ratchet, for allowing the cord reel 417 to rotate in only one direction while the friction member 413 and the cord reel 417 are in contact. A spiral spring 415 with a predetermined restoration force is equipped in the cord reel 417.

Hereinafter, the operation of this invention will be described. The description of the operation is divided into an in use position and an out of use position.

Figure 5:
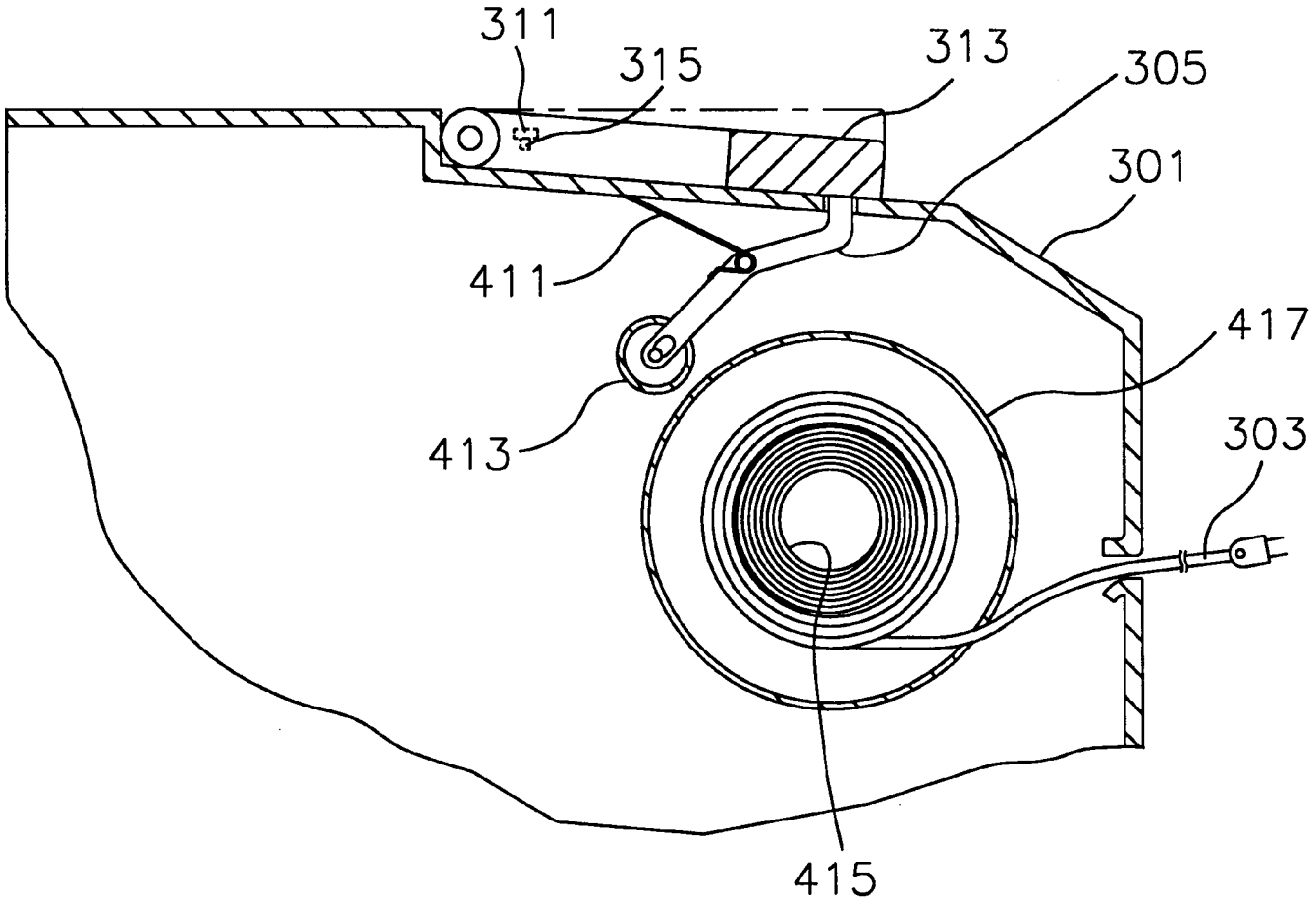
FIG. 5 is a sectional view showing the cord-reel release apparatus not in use.

Firstly, the operation while out of use is described. FIG. 5 is a sectional view showing the cord-reel release apparatus out of use. In FIG. 5, the body 301, the power cord 303, the cord reel lever 305, the hooking depression 311, the handle 313, the hooking prominence 315, the spring 411, the friction member 413, the spiral spring 415, and the cord reel 417 are illustrated.

While out of use, the hooking prominence 315 passes through the hooking depression 311 so that the handle 313 is in close contact with the bottom of the accommodation. The hooking depression 311 blocks the passing of the hooking prominence 315 with force lower than a predetermined force, and allows the passing of the hooking prominence 315 with force higher than a predetermined force due to the elastic reformation. Here, the hooking prominence 315 and the hooking depression 311 distinguish between in use and out of use for the vacuum cleaner.

The cord reel lever 305 is pressed downwardly with the clockwise rotation of the handle 313. The cord reel lever 305 overcomes the elastic force of the spring 411 to rotate at a rotation center on the longitudinal direction. Then, the friction member 413, which is in contact with the cord reel 417 by elastic force and blocks the one directional rotation of the cord reel 417 with friction force, is taken off from the cord reel 417. As a result, the induced power cord for use is wound up at the cord reel 417 by the restoration force of the spiral spring 415 in the cord reel 417.

Figure 6:
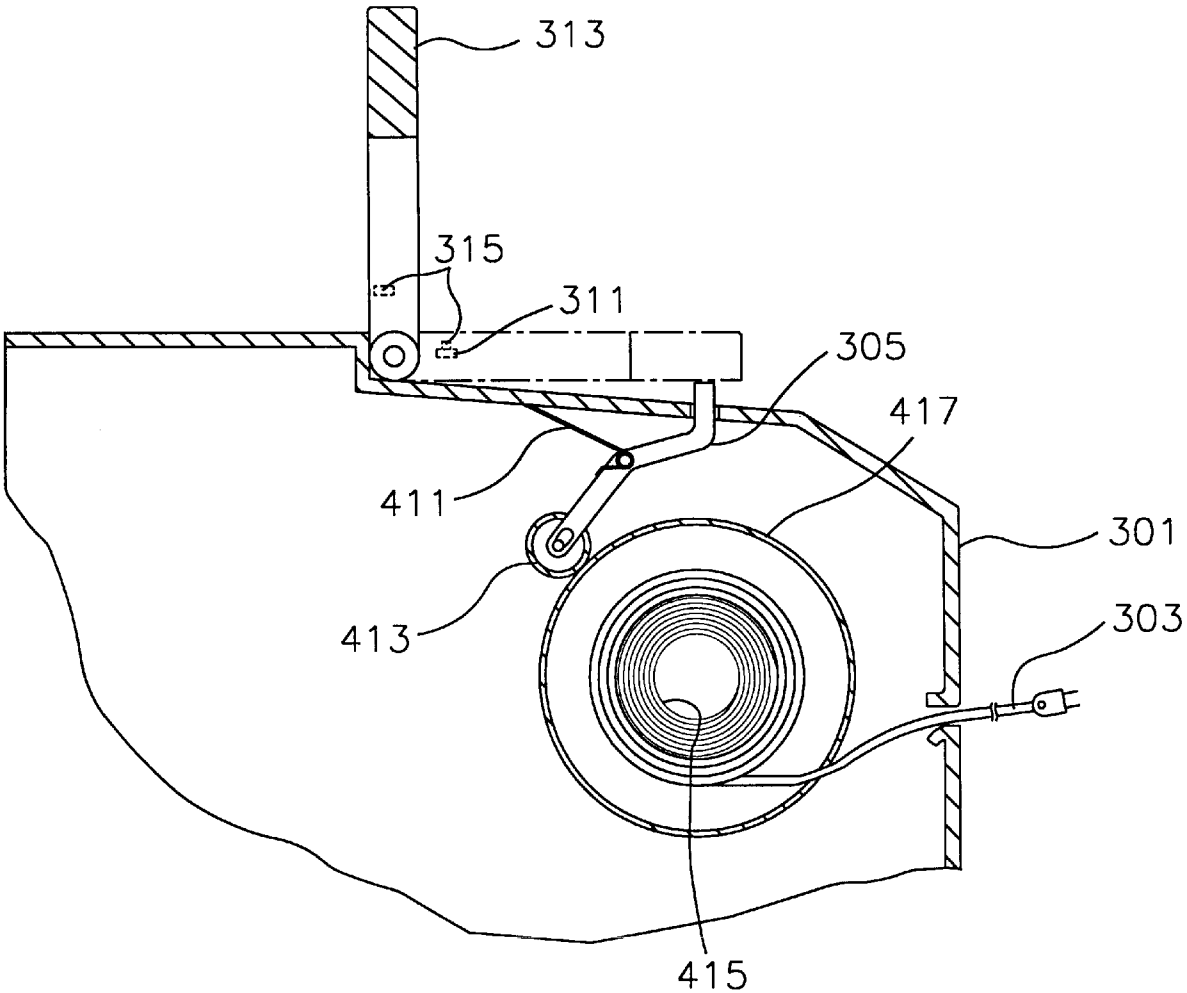
FIG. 6 is a sectional view showing the cord-reel release apparatus in use.

Secondly, the operation during use is described. FIG. 6 is a sectional view showing the cord-reel release apparatus in use. In FIG. 6, the body 301, the power cord 303, the cord reel lever 305, the hooking depression 311, the handle 313, the hooking prominence 315, the spring 411, the friction member 413, the spiral spring 415, and the cord reel 417 are illustrated.

While in use, the handle 313 is positioned perpendicular to the upper surface of the body 301 for a user to carry the vacuum cleaner. At this time the hooking prominence 315 gets out of the hooking depression 311. The hooking depression 311 blocks the passing of the hooking prominence 315 with force lower than a predetermined force, and allows the passing of the hooking prominence 315 with force higher than a predetermined force due to the elastic reformation.

The counter clockwise rotation of the handle 313 causes the cord reel lever 305 to protrude onto the bottom surface of the accommodation groove at the rear part of the body 301. As the cord reel lever 305 is depressed, the spring 411 with an innate elastic force causes the cord reel lever 305 to rotate at a rotation center on the longitudinal direction of the cord reel lever 305. The friction member 413, which is supported by one end part of the cord reel lever 305, is in close contact with the cord reel 417 to block the rotation of the cord reel 417. Then the spiral spring 415 with the restoration force cannot wind up the cord reel 417. As a result, the inducement of the power cord 303, which is wound up at the cord reel 417, is free.

With the above-mentioned constitution and operation, a user of this invention may selectively press the cord reel lever by means of the handle, which is coupled to the body with the handle being axially rotated against the body. Therefore this invention does not need an additional cord reel button to cover the cord reel lever. Such unessential cord reel button makes the constitution of the vacuum cleaner simple. The reduction in the number of the components reduces the cost for manufacturing. As a result, productivity is enhanced.

While this invention has been shown and described with particular embodiments thereof, this invention is not confined to the embodiments. Also, it will be understood by those skilled in the related art that various changes in form and details may be effected therein without departing from the spirit and scope of this invention as defined by the appended claims.

What is claimed is:

1. A vacuum cleaner including a body with a handle having an open position and a closed position and including an apparatus for releasing a cord reel of a cord winder, wherein the apparatus for releasing a cord reel includes:

a cord reel mounted to the body which winds a power cord and holds an elastic force in a direction that the power cord is wound;

a brake member wherein one part thereof is in contact with circumference of the cord reel to selectively limit rotation of the cord reel, and rotates at a predetermined rotation center;

an elastic member which causes the one part of the brake member to be in contact with the circumference of the cord reel; wherein said handle presses in said closed position thereof the other part of the brake member and disengages said one part of the brake member from the cord reel.

2. The apparatus for releasing a cord reel according to claim 1, wherein the cord reel holds the elastic force by means of a spiral spring.

3. The apparatus for releasing a cord reel according to claim 2, wherein the cord reel has a ratchet on the circumference thereof.

4. The apparatus for releasing a cord reel according to claim 1, wherein the other part of the brake member protrudes out of said body of the vacuum cleaner.

5. The apparatus for releasing a cord reel according to claim 1, wherein the handle further includes a hooking prominence formed on a side part thereof, thereby the hooking prominence is hooked to a hooking depression which is formed in an accommodation groove of the body to correspond with the hooking prominence.

* * * * *